US006073804A

United States Patent [19]

Yquel

[11] Patent Number: 6,073,804

[45] Date of Patent: Jun. 13, 2000

[54] DEVICE FOR PACKAGING AND DISPENSING A FLUID

[75] Inventor: Jean-Pierre Yquel, Colombes, France

[73] Assignee: L'Oreal, Paris, France

[21] Appl. No.: 09/181,819

[22] Filed: Oct. 29, 1998

[30] Foreign Application Priority Data

Nov. 13, 1997 [FR] France ..... 97 14236

[51] Int. Cl.[7] ..... B65D 35/28

[52] U.S. Cl. ..... 222/95; 222/92; 222/105

[58] Field of Search ..... 222/95, 92, 105, 222/386.5, 464.1, 464.2

[56] References Cited

U.S. PATENT DOCUMENTS

| | | | |
|---|---|---|---|
| 1,873,817 | 8/1932 | Buddenhagen | 222/95 |
| 4,148,416 | 4/1979 | Gunn-Smith . | |
| 4,381,846 | 5/1983 | Heck | 222/105 |
| 5,730,328 | 3/1998 | Maeder et al. | 222/95 |

FOREIGN PATENT DOCUMENTS

| | | |
|---|---|---|
| 0 196 344 A1 | 10/1986 | European Pat. Off. . |
| 0 444 982 A1 | 9/1991 | European Pat. Off. . |
| 0 549 096 A1 | 6/1993 | European Pat. Off. . |
| 2 658 739 | 8/1991 | France . |

*Primary Examiner*—David J. Walczak
*Attorney, Agent, or Firm*—Oliff & Berridge, PLC

[57] ABSTRACT

A device for packaging and dispensing a fluid, including a receptacle containing a shrinkable bag suitable for shrinking as the quantity of fluid contained inside it diminishes, the device also including extraction means opening out to the inside of the bag. Inside the bag, the device includes a free body whose buoyancy is selected so that it takes up a position close to the extraction means when the device is in use for dispensing a quantity of fluid, the shape and the dimensions of the body also being selected so as to prevent the bag from tearing as it shrinks.

59 Claims, 3 Drawing Sheets

DEVICE FOR PACKAGING AND DISPENSING A FLUID

The present invention relates to a novel device for packaging and dispensing a fluid.

The invention relates more particularly to a device of the type including a receptacle comprising a shrinkable envelope, which envelope shrinks as the quantity of fluid contained therein deceases, the device also including fluid extraction means that open out to the inside of the bag.

BACKGROUND OF THE INVENTION

A device of this type is known from French patent FR 2 658 739.

The fluid contained inside the bag can be expelled by means of a pump that operates without intake of air, or under pressure from a propellant gas present outside the bag but inside the receptacle.

As the bag empties, it shrinks and forms folds.

In some cases, it has been found that the folds or deformations can lead to the bag being torn or pierced, thus making the device unusable.

OBJECTS AND SUMMARY OF THE INVENTION

The present invention seeks in particular to prevent the bag being torn or pierced while it is being emptied.

This is achieved by the fact that the device includes a free body whose buoyancy is selected so that it takes up a position close to the extraction means when the device is in use for dispensing a quantity of fluid, the shape and the dimensions of the body also being selected so as to prevent the bag from tearing as it shrinks.

It has been observed that in prior art devices, the bag is generally torn or pierced in the vicinity of the extraction means.

The body present inside the bag prevents the bag being torn or pierced during dispensing by opposing excessive shrinkage of the bag in the vicinity of the extraction means.

The invention provides means that are particularly simple and low-cost for increasing the reliability of the device.

In a particular embodiment, the bag is generally elongate in shape and it is fixed at one axial end to the receptacle, in the vicinity of the extraction means.

Still in a particular embodiment, the receptacle is pressurized outside the bag and the extraction means include a valve. The device advantageously includes a dispenser endpiece and the bag is fixed to the receptacle at said endpiece.

In an implementation of the invention, the buoyancy of said body is positive and the device is used in the head-up position for dispensing the fluid.

In a variant, the buoyancy of said body is negative and the device is used in the head-down position for dispensing the fluid.

The outside surface of said body is preferably irregular to enable the fluid to flow from the end of the bag to the extraction means, passing via recesses or roughnesses in the surface of the body, once the bag has shrunk onto the body.

BRIEF DESCRIPTION OF THE DRAWINGS

Other characteristics and advantages of the present invention appear on reading the following detailed description of two non-limiting embodiments of the invention and on examining the accompanying drawings, in which.

MORE DETAILED DESCRIPTION

Figure 1:
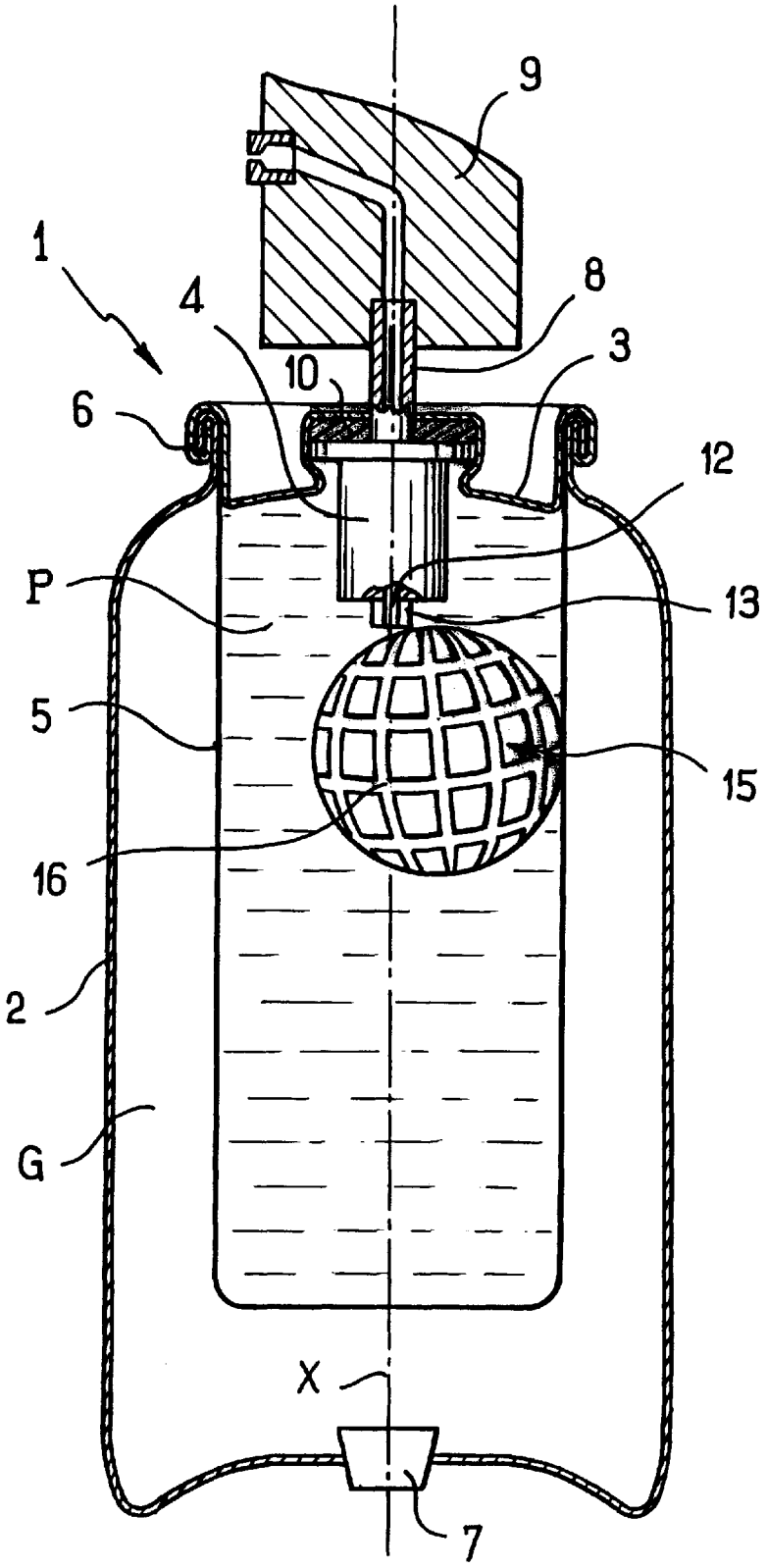
FIG. 1 is a diagrammatic axial section view of a packaging and dispensing device constituting a first embodiment of the invention, shown prior to use.

The packaging and dispensing device 1 shown in FIG. 1 comprises a metal receptacle 2 of the aerosol can type that is elongate in shape along a longitudinal axis X, and that is closed at its top axial end by a metal cup 3.

The cup 3 serves for fixing the extraction means 4 in conventional manner.

In the embodiment described, these extraction means are constituted by a valve 4, comprising a generally circularly cylindrical body provided at its top end with a collar that is held by crimping in a hollow formed in the center of the cup 3.

A bag 5 that is elongate along the axis X has its top free edge fixed to the receptacle 2.

The bag 5 is preferably fixed by placing its wall between the edge wall of the cup 3 and the edge wall of the receptacle 2, both of which are initially circularly cylindrical in shape, and then by rolling up the resulting assembly.

This serves simultaneously to fix the cup 3 to the receptacle 2 and to fix the bag 5 to the receptacle 2.

The bag 5 which is sandwiched between the wall of the cup 3 and the wall of the receptacle 2 also serves to seal the receptacle.

In a variant embodiment that is not shown, the bag 5 is fixed by pinching its wall against the cup 3 and the valve 4 in the hollow formed in the center of the cup 3 which is crimped onto the valve 4.

The bag 5 is completely filled with a fluid P that is to be dispensed.

Outside the bag 5, the receptacle 2 contains a propellant gas G under pressure which acts against the walls of the bag 5 and which thus keeps the fluid contained therein under pressure.

The receptacle 2 is provided with a downwardly concave end wall which may, in a variant, be constituted by an add-on part, and a valve 7 is mounted in the center thereof enabling the receptacle 2 to be filled with the propellant gas G.

The valve 4 has a hollow moving control rod 8 through which the fluid is delivered, the control rod 8 being surmounted by a conventional dispenser endpiece 9.

A gasket 10 is disposed in the bottom of the hollow formed in the center of the cup 3, overlying the valve body 4, so as to seal the receptacle 2 at this point, and in particular so as to enable the control rod 8 to slide in leakproof manner.

The bag 5 is deformable and capable of shrinking as the fluid P is expelled.

Its wall can be made of a plastics material or of a metal, e.g. aluminum, or it can be in the form of a multilayer plastic-and-metal structure.

Which particular materials are used depends on the nature of the fluid P.

The inlet orifice of the valve 4 is extended downwards by a length of duct, which length of duct is provided with axial openings 12 to constitute a strainer 13 that cannot be blocked by the bag 5 as it shrinks.

To prevent the bag 5 being pierced or torn in the vicinity of the zone where it is fixed to the receptacle, and in particular to prevent the bag being damaged on coming into contact with the bottom edge of the cylindrical body of the valve 4, a free body 15 is placed inside the bag 5. The dimensions of the body 15 are selected to enable it to be inserted through the opening of the receptacle 2 before the cup 3 is put into place.

By way of example, the body 15 may be in the form of a hollow sphere of plastics material whose buoyancy in the fluid P is positive so that when the device 1 is in its normal position of use, i.e. with its dispenser endpiece 9 on top, the body 15 tends to occupy a position immediately below the valve 4, bearing against the strainer 13.

Figure 2:
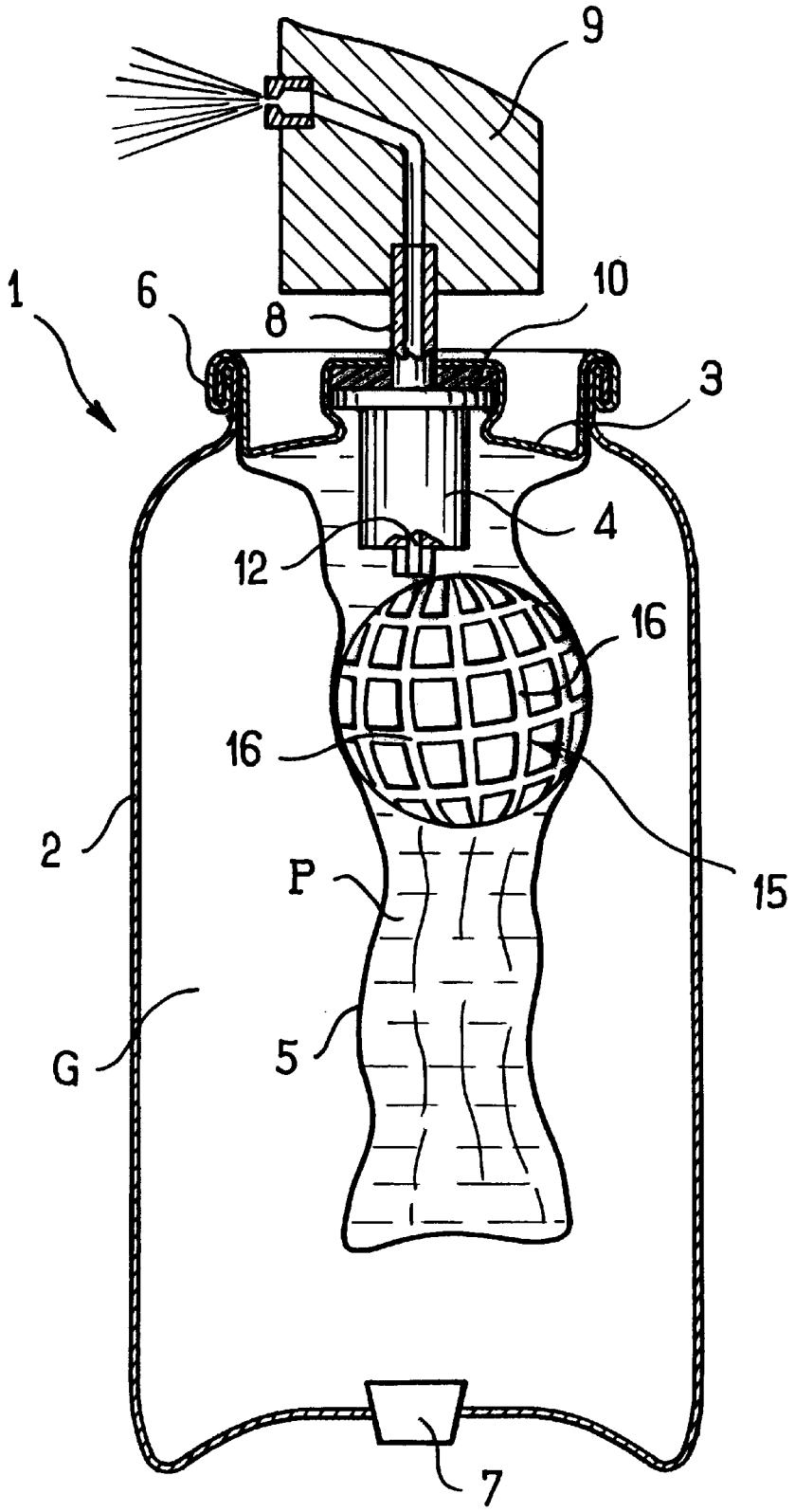
FIG. 2 shows the FIG. 1 device after use.

The body 15 has fluting 16 in its outside surface to enable the fluid P to flow from the end of the bag 5 towards the strainer 13 even when the bag 5 has shrunk onto the body 15, as shown in FIG. 2. The bag 5 is not flexible enough to block the fluting as it shrinks onto the body 15.

The diameter of the body 15 is such as to prevent the formation of zones of weakness which can lead to tearing or piercing in the vicinity of the valve 4 and of the zone where the bag 5 is fixed to the receptacle.

In particular, the body 15 prevents the wall of the bag from coming into contact with the extraction means 4.

In the example described, the diameter of the body 15 is substantially three times the diameter of the cylindrical body of the valve 4.

The body 15 is placed in the bag 5 after it has been filled, and the bag is then fixed to the cup 3 and to the receptacle 2 by deforming their superposed walls, as explained above.

To dispense the fluid P, the user presses on the dispenser endpiece 9, thereby moving the control rod 8 into the valve body 4 and causing the fluid P to be expelled under drive from the propellant gas G contained outside the bag 5 but inside the receptacle 2.

As soon as the user releases pressure on the dispenser endpiece 9, the control rod 8 rises and stops the fluid being dispensed.

While the fluid is being dispensed, the bag 5 shrinks; however, by limiting the formation of zones of weakness, the body 15 prevents the bag from tearing or being pierced.

In the example described, the body 15 is hollow, but it is possible to use a solid body without going beyond the ambit of the present invention, providing the density thereof is less than that of the fluid P, so that the body floats in the fluid.

The embodiment described above relates to a dispenser device which is used in the head-up position.

When the fluid is dispensed from a head-down position, the buoyancy of the body which protects the bag 5 against tearing should be negative so that the body sinks in the fluid P.

Figure 3:
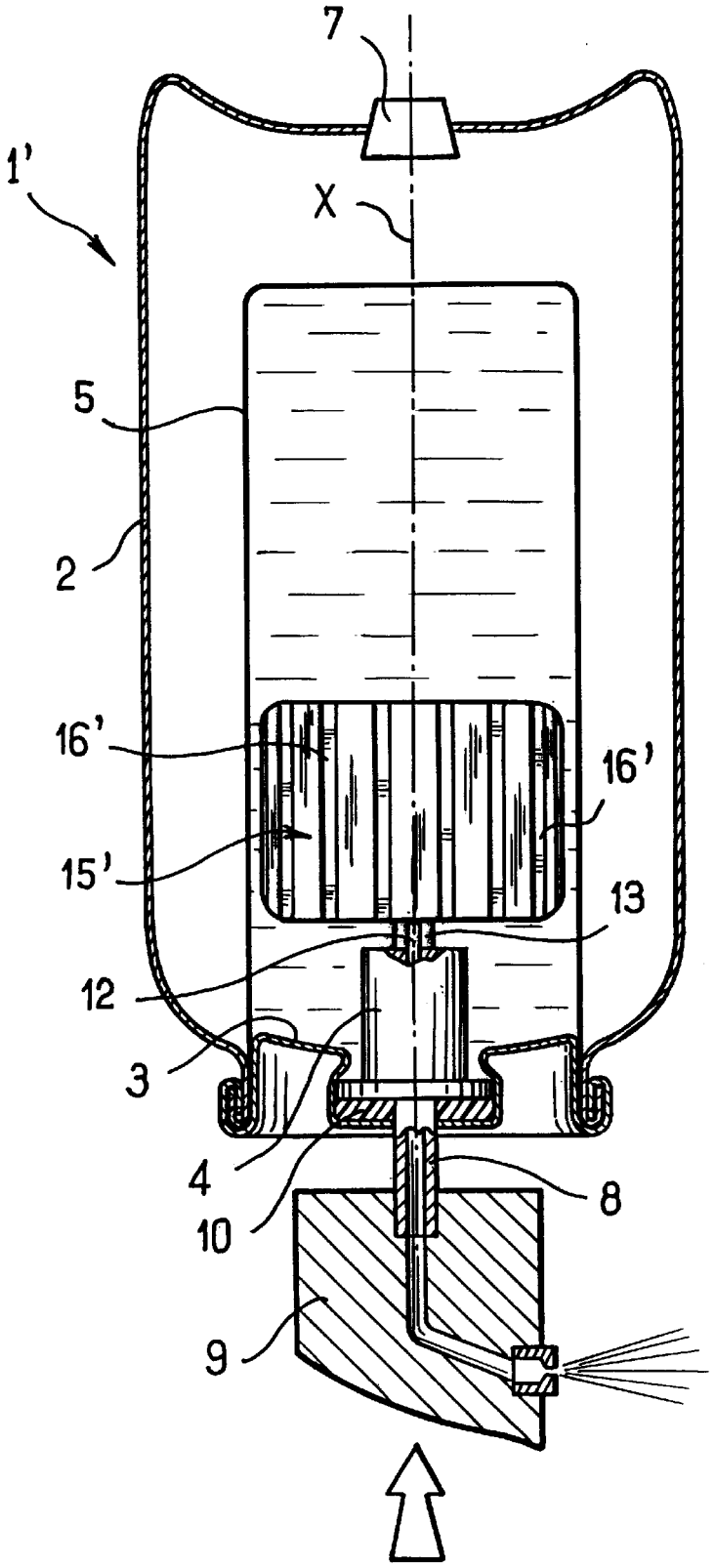
FIG. 3 is a diagrammatic axial section view of a packaging and dispensing device constituting a second embodiment of the invention.

FIG. 3 shows a packaging and dispenser device 1' which is designed to be used in the head-down position and which differs from the preceding embodiment by the shape and the buoyancy of the body used for protecting the bag against piercing or tearing.

In general, the shape of the body is rounded and without any projecting portions, so as to prevent folds or tears forming on the bag coming into contact therewith.

Also in general, the transverse size of the body is greater than the largest transverse dimension of the extraction means 4.

In the description below, identical reference symbols are used to designate the same component elements as in the embodiment described above.

The body for protecting the bag 5, which in this embodiment is referenced 15', is generally cylindrical in shape, having its axis substantially parallel to the longitudinal axis X of the receptacle 2, and it is provided in its periphery with axial fluting 16' that enables fluid being extracted to flow out, even when the bag 5 has shrunk onto the body 15'.

The diameter of the body 15' is substantially three times the diameter of the cylindrical body of the valve 4.

In use, since the dispenser endpiece 9 is at the bottom end, the body 15' of negative buoyancy rests against the strainer 13 and prevents the bag 5 from forming folds as it shrinks, which folds could lead to the bag being torn or pierced in the vicinity of the valve 4.

Tests performed by the Applicant company have shown that merely having the body 15 or 15' present inside the bag makes it possible to reduce the puncture rate to zero, whereas in prior art devices the puncture rate was greater than 10%.

The cost of installing the body 15 or 15' is relatively small and in any event much less than the cost of providing a protective part which is fitted directly to the valve.

In addition, it has been observed that the presence of the floating body makes it possible to obtain better emptying of the bag 5 than can be obtained when using such a protective part on the valve.

Naturally, the invention is not limited to the embodiments described above.

In particular, the shape of the receptacle 2 and the shape of the bag 5 can be modified very widely without going beyond the ambit of the present invention.

The receptacle 2 can be made of plastics material, and be pierced by an orifice allowing ingress of atmospheric air, with the valve 4 then being replaced by a pump that operates without air intake.

The body protecting the bag 5 from tearing and piercing can be made of any plastic material that is compatible with the nature of the fluid, for example it can be made of polyethylene.

What is claimed is:

1. A device for packaging and dispensing a fluid, said device including a receptacle containing a collapsible bag suitable for collapsing as the quantity of fluid contained inside it diminishes, the device also including dispensing means opening out to the inside of the bag, wherein inside the bag it includes a free body whose buoyancy is selected so that it takes up a position close to the dispensing means when the device is in use for dispensing a quantity of fluid, the shape and the dimensions of the body also being selected so as to prevent the bag from tearing as it collapses, wherein the receptacle is pressurized outside the bag and wherein said dispensing means comprises a valve.

2. A device according to claim 1, wherein said bag is generally elongate in shape and wherein it is fixed via its free edge to the receptacle in the vicinity of the dispensing means.

3. A device according to claim 1, wherein the wall of the bag includes a thickness of metal.

4. A device according to claim 3, wherein the metal is aluminum.

5. A device according to claim 1, including a dispenser endpiece and wherein the bag is fixed to the receptacle adjacent to said dispenser endpiece.

6. A device according to claim 5, wherein the buoyancy of said body in the fluid is positive, and wherein the device is used in a head-up position for dispensing the fluid.

7. A device according to claim 5, wherein the buoyancy of said body in the fluid is negative and wherein the device is used in the head-down position for dispensing the fluid.

8. A device according to claim 1, wherein the outside surface of said body is irregular.

9. A device according to claim 8, wherein the outside surface of said body presents fluting.

10. A device according to claim 1, wherein the general shape of said body is rounded.

11. A device according to claim 10, wherein the general shape of said body is spherical or cylindrical and without any projecting portions.

12. A device according to claim 1, wherein the transverse dimension of said body is greater than the greatest transverse dimension of said dispensing means.

13. A device for packaging and dispensing a fluid, said device including a receptacle containing a collapsible bag suitable for collapsing as the quantity of fluid contained inside it diminishes, the device also including dispensing means opening out to the inside of the bag, wherein inside the bag it includes a free body whose buoyancy is selected so that it takes up a position close to the dispensing means when the device is in use for dispensing a quantity of fluid, the shape and dimensions of the body also being selected so as to prevent the bag from tearing as it collapses, wherein the buoyancy of said body in the fluid is positive, and wherein the device is used in a head-up position for dispensing the fluid.

14. A device according to claim 13, wherein said bag is generally elongate in shape and wherein it is fixed via its free edge to the receptacle in the vicinity of the dispensing means.

15. A device according to claim 13, wherein the receptacle is pressurized outside the bag and wherein said dispensing means comprise a valve.

16. A device according to claim 13, wherein the wall of the bag includes a thickness of metal.

17. A device according to claim 16, wherein the metal is aluminum.

18. A device according to claim 13, including a dispenser endpiece and wherein the bag is fixed to the receptacle adjacent to said dispenser endpiece.

19. A device according to claim 13, wherein the outside surface of said body is irregular.

20. A device according to claim 19, wherein the outside surface of said body presents fluting.

21. A device according to claim 13, wherein the general shape of said body is rounded.

22. A device according to claim 21, wherein the general shape of said body is spherical or cylindrical and without any projecting portions.

23. A device according to claim 13, wherein the transverse dimension of said body is greater than the greatest transverse dimension of said dispensing means.

24. A device for packaging and dispensing a fluid, said device including a receptacle containing a collapsible bag suitable for collapsing as the quantity of fluid contained inside it diminishes, the device also including dispensing means opening out to the inside of the bag, wherein inside the bag it includes a free body whose buoyancy is selected so that it takes up a position close to the dispensing means when the device is in use for dispensing a quantity of fluid, wherein the general shape of said body is rounded, the shape and the dimensions of the body also being selected so as to prevent the bag from tearing as it collapses.

25. A device according to claim 24, wherein said bag is generally elongate in shape and wherein it is fixed via its free edge to the receptacle in the vicinity of the dispensing means.

26. A device according to claim 24, wherein the receptacle is pressurized outside the bag and wherein said dispensing means comprise a valve.

27. A device according to claim 24, wherein the wall of the bag includes a thickness of metal.

28. A device according to claim 27, wherein the metal is aluminum.

29. A device according to claim 24, including a dispenser endpiece and wherein the bag is fixed to the receptacle adjacent to said dispenser endpiece.

30. A device according to claim 29, wherein the buoyancy of said body in the fluid is positive, and wherein the device is used in a head-up position for dispensing the fluid.

31. A device according to claim 29, wherein the buoyancy of said body in the fluid is negative and wherein the device is used in the head-down position for dispensing the fluid.

32. A device according to claim 24, wherein the outside surface of said body is irregular.

33. A device according to claim 32, wherein the outside surface of said body presents fluting.

34. A device according to claim 24, wherein the transverse dimension of said body is greater than the greatest transverse dimension of said dispensing means.

35. A device according to claim 24, wherein the general shape of said body is spherical or cylindrical and without any projecting portions.

36. A device for packaging and dispensing a fluid, said device including a receptacle containing a collapsible bag suitable for collapsing as the quantity of fluid contained inside it diminishes, the device also including dispensing means opening out to the inside of the bag, wherein inside the bag it includes a free body whose buoyancy is selected so that it takes up a position close to the dispensing means when the device is in use for dispensing a quantity of fluid, the shape and the dimensions of the body also being selected so as to prevent the bag from tearing as it collapses, wherein the buoyancy of said body in the fluid is negative, and wherein the device is used in a head-down position for dispensing the fluid.

37. A device according to claim 36, wherein said bag is generally elongate in shape and wherein it is fixed via its free edge to the receptacle in the vicinity of the dispensing means.

38. A device according to claim 36, wherein the receptacle is pressurized outside the bag and wherein said dispensing means comprise a valve.

39. A device according to claim 36, wherein the wall of the bag includes a thickness of metal.

40. A device according to claim 39, wherein the metal is aluminum.

41. A device according to claim 36, including a dispenser endpiece and wherein the bag is fixed to the receptacle adjacent to said dispenser endpiece.

42. A device according to claim 36, wherein the outside surface of said body is irregular.

43. A device according to claim 42, wherein the outside surface of said body presents fluting.

44. A device according to claim 36, wherein the general shape of said body is rounded.

45. A device according to claim 44, wherein the general shape of said body is spherical or cylindrical and without any projecting portions.

46. A device according to claim 36, wherein the transverse dimension of said body is greater than the greatest transverse dimension of said dispensing means.

47. A device for packaging and dispensing a fluid, said device including a receptacle containing a collapsible bag suitable for collapsing as the quantity of fluid contained inside it diminishes, the device also including dispensing means opening out to the inside of the bag, wherein inside the bag it includes a free body whose buoyancy is selected so that it takes up a position close to the dispensing means when the device is in use for dispensing a quantity of fluid, the shape and dimensions of the body also being selected so as to reduce the formation of folds or weakness zones that could cause the bag to tear as it collapses.

48. A device according to claim 47, wherein said bag is generally elongate in shape and wherein it is fixed via its free edge to the receptacle in the vicinity of the dispensing means.

49. A device according to claim 47, wherein the receptacle is pressurized outside the bag and wherein said dispensing means comprises a valve.

50. A device according to claim 47, wherein the wall of the bag includes a thickness of metal.

51. A device according to claim 50, wherein the metal is aluminum.

52. A device according to claim 47, including a dispenser endpiece and wherein the bag is fixed to the receptacle adjacent to said dispenser endpiece.

53. A device according to claim 52, wherein the buoyancy of said body in the fluid is positive, and wherein the device is used in a head-up position for dispensing the fluid.

54. A device according to claim 52, wherein the buoyancy of said body in the fluid is negative and wherein the device is used in the head-down position for dispensing the fluid.

55. A device according to claim 47, wherein the outside surface of said body is irregular.

56. A device according to claim 55, wherein the outside surface of said body presents fluting.

57. A device according to claim 47, wherein the general shape of said body is rounded.

58. A device according to claim 57, wherein the general shape of said body is spherical or cylindrical and without any projecting portions.

59. A device according to claim 47, wherein the transverse dimension of said body is greater than the greatest transverse dimension of said dispensing means.

* * * * *